US005399799A

United States Patent [19]

Gabriel

[11] Patent Number: 5,399,799

[45] Date of Patent: Mar. 21, 1995

[54] METHOD AND APPARATUS FOR RETRIEVING PRE-RECORDED SOUND PATTERNS IN SYNCHRONIZATION

[75] Inventor: Joshua Gabriel, Venice, Calif.

[73] Assignee: Interactive Music, Inc., Mountain View, Calif.

[21] Appl. No.: 940,473

[22] Filed: Sep. 4, 1992

[51] Int. Cl.[6] ..... G10H 7/00; G04B 13/00; A63H 5/00

[52] U.S. Cl. ..... 84/609

[58] Field of Search ..... 84/601–603, 84/609–611, 645

[56] References Cited

U.S. PATENT DOCUMENTS

| | | | |
|---|---|---|---|
| 4,350,071 | 9/1982 | Kondo . | |
| 4,993,306 | 2/1991 | Veta et al. | 84/601 |
| 5,054,360 | 10/1991 | Lisle et al. | 84/645 |
| 5,164,529 | 11/1992 | Saito | 84/612 |
| 5,220,119 | 6/1993 | Shimada | 84/609 |
| 5,225,618 | 7/1993 | Wadhams | 84/645 |
| 5,295,123 | 3/1994 | Seri et al. | 84/645 X |
| 5,342,990 | 8/1994 | Rossum | 84/603 |

*Primary Examiner*—Jonathan Wysocki
*Assistant Examiner*—Jeffrey W. Donels
*Attorney, Agent, or Firm*—Kenneth M. Kaslow; Leo V. Novakoski

[57] ABSTRACT

A method and apparatus for playing a first sequence of sounds represented by data stored in memory synchronously with a second sequence of sounds represented by data stored in memory, at any point during the playing of the second sequence of sounds. A point in time is selected at which a specific sound in the first sequence of sounds must be played at the same time as the specific sound in the second sequence of sounds for the two sequences to be synchronous. The number of sounds in the second sequence which have been played before the current sound being played is counted and used to determine which sound in the first sequence is synchronous with the current sound in the second sequence. The data representing both sounds is then retrieved and used to generate, i.e. to "play," the identified sound in the first sequence simultaneously with the current sound of the second sequence.

18 Claims, 5 Drawing Sheets

FIG. 2

```
12 → SET CURRENT-TIME = VALUE OF CLOCK REGISTER
14 → SET END-TIME = CURRENT-TIME + SPEED

20 { SET CURRENT-JOYSTICK-POSITION = VALUE OF THE JOYSTICK
       REGISTER
     SET CURRENT-POSITION-ARRAY = THE ARRAY FOR THE CURRENT
       POSITION
     SET CURRENT-POSITION-BEAT-INDEX = THE BEAT-INDEX FOR THE
       CURRENT-JOYSTICK-POSITION

22, 24 → PUT INTO PLAY-BUFFER THE SOUND NUMBER IN
           CURRENT-POSITION-ARRAY AT CURRENT-POSITION-BEAT-INDEX
16, 18 → PUT INTO PLAY-BUFFER THE SOUND NUMBER IN BASIC-TRACK-1...
           n-ARRAY AT BASIC-TRACK-1...n-BEAT-INDEX

26 { SET UP-BEAT-INDEX = UP-BEAT-INDEX + 1
     SET DOWN-BEAT-INDEX = DOWN-BEAT-INDEX + 1
     SET LEFT-BEAT-INDEX = LEFT-BEAT-INDEX + 1
     SET RIGHT-BEAT-INDEX = RIGHT-BEAT-INDEX + 1
     SET UP-LEFT-BEAT-INDEX = UP-LEFT-BEAT-INDEX + 1
     SET UP-RIGHT-BEAT-INDEX = UP-RIGHT-BEAT-INDEX + 1
     SET DOWN-RIGHT-BEAT-INDEX = DOWN-RIGHT-BEAT-INDEX + 1
     SET DOWN-LEFT-BEAT-INDEX = DOWN-LEFT-BEAT-INDEX + 1
     SET CENTER-BEAT-INDEX = CENTER-BEAT-INDEX + 1
     SET BASIC-TRACK-1...n-BEAT-INDEX = BASIC-TRACK-1...
     n-BEAT-INDEX + 1

28, 30 { IF UP-BEAT-INDEX > UP-BEAT-INDEX-LENGTH THEN
           SET UP-BEAT-INDEX = 0
         IF DOWN-BEAT-INDEX > DOWN-BEAT-INDEX-LENGTH THEN
           SET DOWN-BEAT-INDEX = 0
         IF LEFT-BEAT-INDEX > LEFT-BEAT-INDEX-LENGTH THEN
           SET LEFT-BEAT-INDEX = 0
         IF RIGHT-BEAT-INDEX > RIGHT-BEAT-INDEX-LENGTH THEN
           SET RIGHT-BEAT-INDEX = 0
         IF UP-LEFT-BEAT-INDEX > UP-LEFT-BEAT-INDEX-LENGTH THEN
           SET UP-LEFT-BEAT-INDEX = 0
         IF UP-RIGHT-BEAT-INDEX > UP-RIGHT-BEAT-INDEX-LENGTH THEN
           SET UP-RIGHT-BEAT-INDEX = 0
         IF DOWN-RIGHT-BEAT-INDEX > DOWN-RIGHT-BEAT-INDEX-LENGTH
           THEN SET DOWN-RIGHT-BEAT-INDEX = 0
         IF DOWN-LEFT-BEAT-INDEX > DOWN-LEFT-BEAT-INDEX-LENGTH
           THEN SET DOWN-LEFT-BEAT-INDEX = 0
         IF CENTER-BEAT-INDEX > CENTER-BEAT-INDEX-LENGTH THEN
           SET CENTER-BEAT-INDEX = {}
         IF BASIC-TRACK-1...n-BEAT-INDEX > BASIC-TRACK-1...n-BEAT-
           INDEX-LENGTH THEN SET BASIC-TRACK-1...n-BEAT-INDEX = 0

34 { → PLAY THE SOUNDS WITH THE NUMBERS FROM PLAY-BUFFER
     → SET PLAY-BUFFER = 0

32 → WAIT UNTIL THE VALUE OF THE CLOCK REGISTER > = END-TIME
       LOOP TO START
```

| BASIC TRACK NOTE COUNTER | PATTERN 1 NOTE COUNTER | PATTERN 2 NOTE COUNTER |
|---|---|---|
| 0 | 0 | 0 |
| 1 | 1 | 1 |
| 2 | 2 | 2 |
| 3 | 3 | 3 |
| 4 | 4 | 4 |
| 5 | 5 | 5 |
| 6 | 6 | 6 |
| 7 | 7 | 7 |
| 8 | 0 | 8 |
| 9 | 1 | 9 |
| 10 | 2 | 10 |
| 11 | 3 | 11 |
| 12 | 4 | 0 |
| 13 | 5 | 1 |
| 14 | 6 | 2 |
| 15 | 7 | 3 |
| 16 | 0 | 4 |
| 17 | 1 | 5 |
| 18 | 2 | 6 |
| 19 | 3 | 7 |
| 20 | 4 | 8 |
| 21 | 5 | 9 |
| 22 | 6 | 10 |
| 23 | 7 | 11 |
| 24 | 0 | 0 |
| 25 | 1 | 1 |
| 26 | 2 | 2 |
| 27 | 3 | 3 |
| 28 | 4 | 4 |
| 29 | 5 | 5 |
| 30 | 6 | 6 |
| 31 | 7 | 7 |
| 32 | 0 | 8 |
| 33 | 1 | 9 |

FIG. 4

METHOD AND APPARATUS FOR RETRIEVING PRE-RECORDED SOUND PATTERNS IN SYNCHRONIZATION

BACKGROUND OF THE INVENTION

1. Field of the Invention

This invention relates generally to retrieval of prerecorded sound patterns, and more particularly to a method and apparatus for retrieving one or more sound patterns stored in memory, such as RAM or ROM, in synchronization with a portion of music at any point in the music.

2. Description of the Relevant Art

Various types of electronic organs and keyboards have been seen over the years, as well as various types of digital sound processors. One area of interest to some users is the ability to take a song, or a basic repeating pattern, and superimpose an additional pattern on top of the song. While the prior art devices known to Applicant are in some ways capable of adding one of a plurality of patterns to an underlying "song," one common problem is that it is difficult to synchronize the pattern with the underlying song, particularly where the pattern chosen to be added to the song may be of any length.

It is believed that electronic organs and keyboards solve this problem by limiting both the underlying "song" and the additional pattern to be added so that each is a measure which is continuously repeated. Thus, the device need merely wait until the end of a measure to begin adding the desired pattern, and the pattern will always be synchronous with the underlying "song" or pattern. The user typically then adds additional notes through an input device such as a piano-style keyboard.

This type of device limits the addition of the pattern to the beginning of a measure. It is also believed that another limitation of these devices is that the entire measure must be stored somehow in order to be continuously retrieved. To store an entire song, and several patterns which might be added to the song would take an enormous amount of memory.

The present invention avoids these deficiencies and allows the user to define both an underlying song and one or more sound patterns to be added to the song of any length, with a minimum amount of memory needed to store them, and to begin adding the pattern synchronous with the song at any time during the song.

SUMMARY OF THE INVENTION

In accordance with the illustrated preferred embodiment, the present invention provides a method and apparatus for playing a first sequence of sounds represented by data stored in memory synchronously with a second sequence of sounds represented by data stored in memory, at any point during the playing of the second sequence of sounds. A point in time is selected at which a specific sound in the first sequence of sounds must be played at the same time as the specific sound in the second sequence of sounds for the two sequences to be synchronous, typically the beginning of each sequence. The number of sounds in the second sequence which have been played before the current sound being played is counted and used to determine which sound in the first sequence is synchronous with the current sound in the second sequence. The data representing both sounds is then retrieved and used to generate, i.e. to "play," the identified sound in the first sequence simultaneously with the current sound of the second sequence.

The features and advantages described in the specification are not all inclusive, and particularly, many additional features and advantages will be apparent to one of ordinary skill in the art in view of the drawings, specification and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

BRIEF DESCRIPTION OF THE DRAWINGS

FIG. 2 is a listing of computer-like code of the flowchart of FIG. 1.

FIG. 4 is a timeline of a basic track and two sound patterns as they may exist in the present invention.

DETAILED DESCRIPTION OF THE PREFERRED EMBODIMENT

FIGS. 1 through 6 of the drawings depict various preferred embodiments of the present invention for purposes of illustration only. One skilled in the art will readily recognize from the following discussion that alternative embodiments of the structures and methods illustrated herein may be employed without departing from the principles of the invention described herein.

In the present invention, various sound patterns may be added to a basic track. Some sounds must first be recorded in a memory, as further explained below. Depending upon the amount of memory available, the basic track and each sound pattern may be of any desired length which is independent of the length of any other pattern or the basic track, the only non-memory limitation being that the cadences of the patterns should be such that they are musically pleasing when added to the basic track.

In the preferred embodiment, data is supplied to a sound generating chip which produces the desired sound or sounds from the data. The data may include the address or addresses of actual recorded sounds which are digitized and stored and/or parameter data which instructs the sound chip as to how to play back the recorded sounds at the specified address(es), i.e. how to alter some of the parameters of the sound. This is explained in more detail below.

Figure 1:
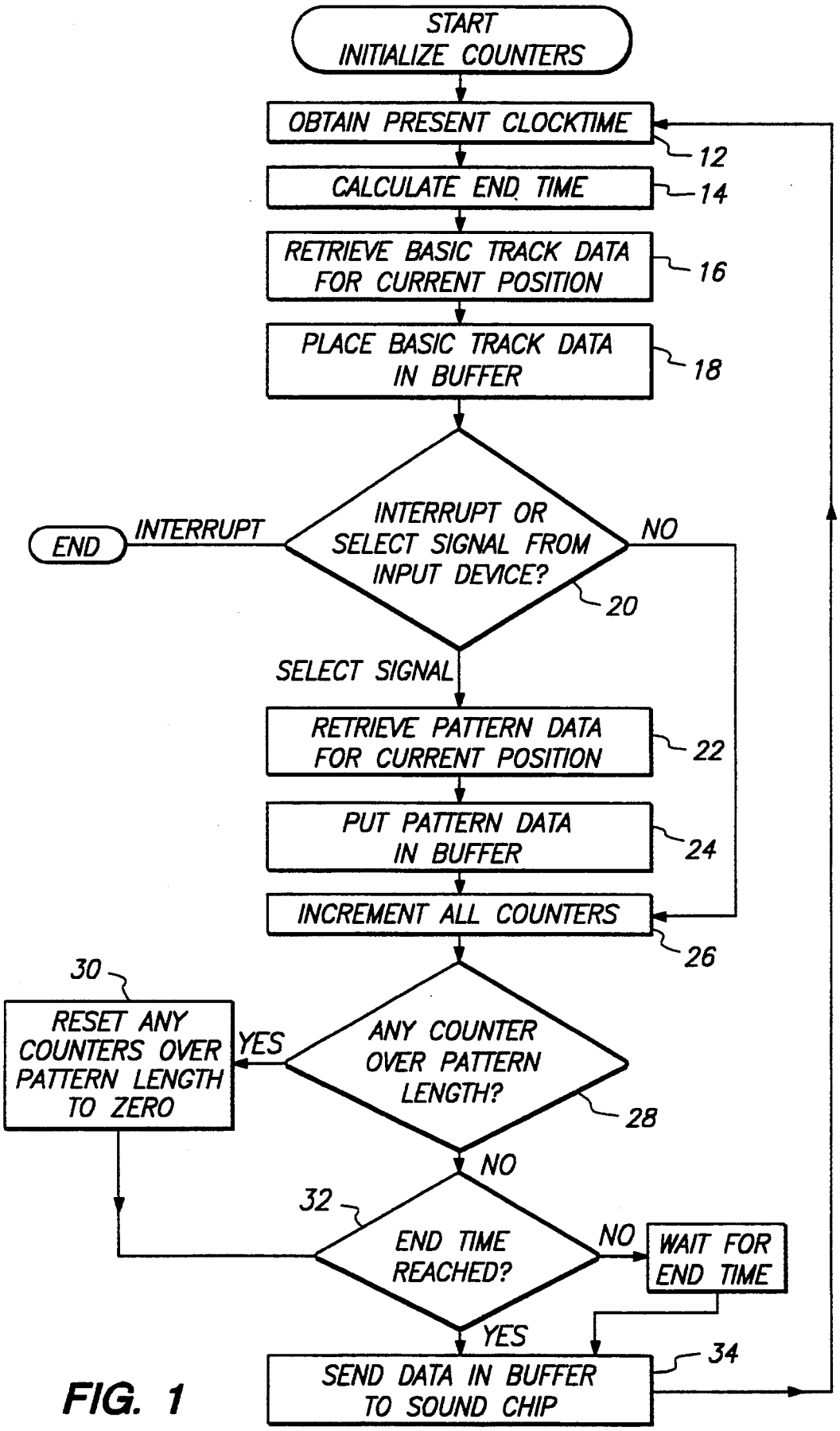
FIG. 1 is a flowchart of the method of the present invention.
Figure 3:
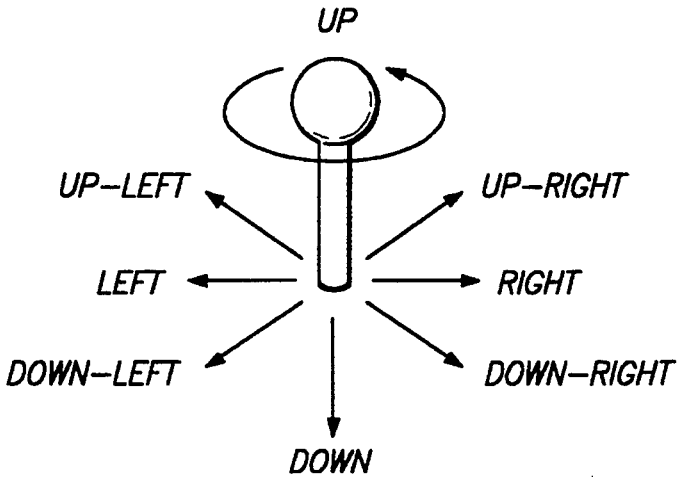
FIG. 3 illustrates a joystick-type input device which may be used with the present invention.

The preferred embodiment of the present invention is broadly outlined in the flowchart shown in FIG. 1. A listing of computer-like code for this flowchart is shown in FIG. 2. One skilled in the art will easily recognize that in some instances the specific order of steps is not critical and may be varied as desired, for example, for ease of programming. When the system is activated by the user, counters for the basic track and for each available sound pattern are initialized to zero. These counters are incremented each time a "note" is played, i.e. each time the system goes through a cycle, as explained more fully below. (The term "note" is used herein to represent a sound of predetermined duration as also explained below; however, a "note" may actually be any collection of sounds, including but not limited to musical notes, which may be sampled and stored in memory as explained herein.)

At step 12, the present time is obtained from a clock, normally the clock of a microprocessor which runs a program implementing the method through software. At step 14, the end time of the cycle is calculated by adding a predetermined period to the current time. At step 16 the basic track data for the note corresponding to the present position of the basic track counter is retrieved. This data is again generally the address of a note or notes to be played and playback parameters for the note(s). This basic track data is placed into the play buffer at step 18.

At step 20, the system looks to see if an interrupt signal has been received from the input device which indicates that the user has signaled to end the song. If so, the song is ended. If there is no such signal, it is determined whether the user has selected a particular pattern to be added to the basic track by looking for a signal from an input device. In the preferred embodiment, the input device is a joystick having eight positions in the directions up, down, left, right, up left, down left, up right and down right, as shown on FIG. 3. If the input device is in the default position or condition (the center position of a joystick), then the system skips to step 26 because there is no pattern to be added to the basic track.

If the user has selected a pattern to be added, the system proceeds to step 22, where the sound pattern data corresponding to the present position of the counter for that sound pattern is retrieved. As with the basic track data, the sound pattern data is some combination of one or more addresses for a note or notes and parameters for playback of the note(s). The sound pattern data is also placed in the play buffer at step 24.

At step 26, all of the counters are incremented, including not only the basic track counter and the sound pattern counter for the pattern selected, but those for all of the other sound patterns as well. Next, at step 28, the system looks to see if any counter reads higher than the number of notes in the sound pattern to which that counter corresponds. If so, that counter is reset to zero at step 30, without affecting any of the other counters.

At step 32, the clock is checked and compared to the end time of the note as calculated in step 14. If the end time has not been reached, the system waits until the end time is reached. Once the end time is reached, at step 34 the system sends the data in the play buffer, which contains the addresses of the notes to be played and the parameters for playing them, to the sound chip, which generates the notes from the recorded sounds at the specified addresses and the associated parameters. In shorter terms, the selected notes of the basic track and any selected sound pattern are played. The play buffer is now empty.

Finally, the system returns to step 12 to begin the process of playing the next note in the song.

As the system begins the next cycle, the counters all read "1" rather than zero (unless a sound pattern is only one note long, in which case its counter would be reset on every note, an unlikely event). As the system progresses through multiple cycles, and the counters are reset at different cycles, they will eventually have different values. However, it can be readily seen that by incrementing each counter in each cycle, it is always clear which note of a pattern should be played next to be properly synchronous with the basic track at any point in time. One sample of this can be seen in FIG. 4, in which only two sound patterns are shown along with a basic track. Here sound pattern 1 has 8 notes, while sound pattern 2 has 12 notes. As can be seen, while the proper position in pattern 1 is the same as the proper position in pattern 2 for the first cycle of pattern 1, after that the proper positions diverge until a point is reached at which each pattern has been completed an integral number of times and thus both start over at the same time, here at note 24. If the patterns are different, for example if pattern 1 is 12 notes and pattern 2 is 16 notes, then the point at which the patterns both start over might be later, in this case at note 48. The counters keep track of which note in each pattern is appropriate for the current note of the basic track.

This feature allows the user to select a pattern at any point in time, and the system will add the pattern to the basic track essentially immediately, i.e. on the present note or the next note. If the input device is activated prior to step 20, the system can receive the signal that the user has selected a sound pattern in time to retrieve the proper note of the sound pattern and include it with the present note of the basic track. If the input device is activated after step 20, the system will not add the selected sound pattern to the basic track until the following note. This delay will be virtually undetectable by the user, who will perceive that the sound pattern that he or she has selected is immediately added to the basic track.

The patterns can be represented by as little as a single note which is reproduced with different parameters to sound differently. For example, the pattern for a tambourine having 16 sequential notes, may be represented by a single recorded tambourine note and 16 sets of parameters for playing that recorded note. These parameters may include such things as amplitude or loudness, the envelope of the sound, i.e. how long it is sustained or decays, its pitch or frequency, etc. The precise parameters used will depend in part upon the capability of the sound chip used.

Figure 5:
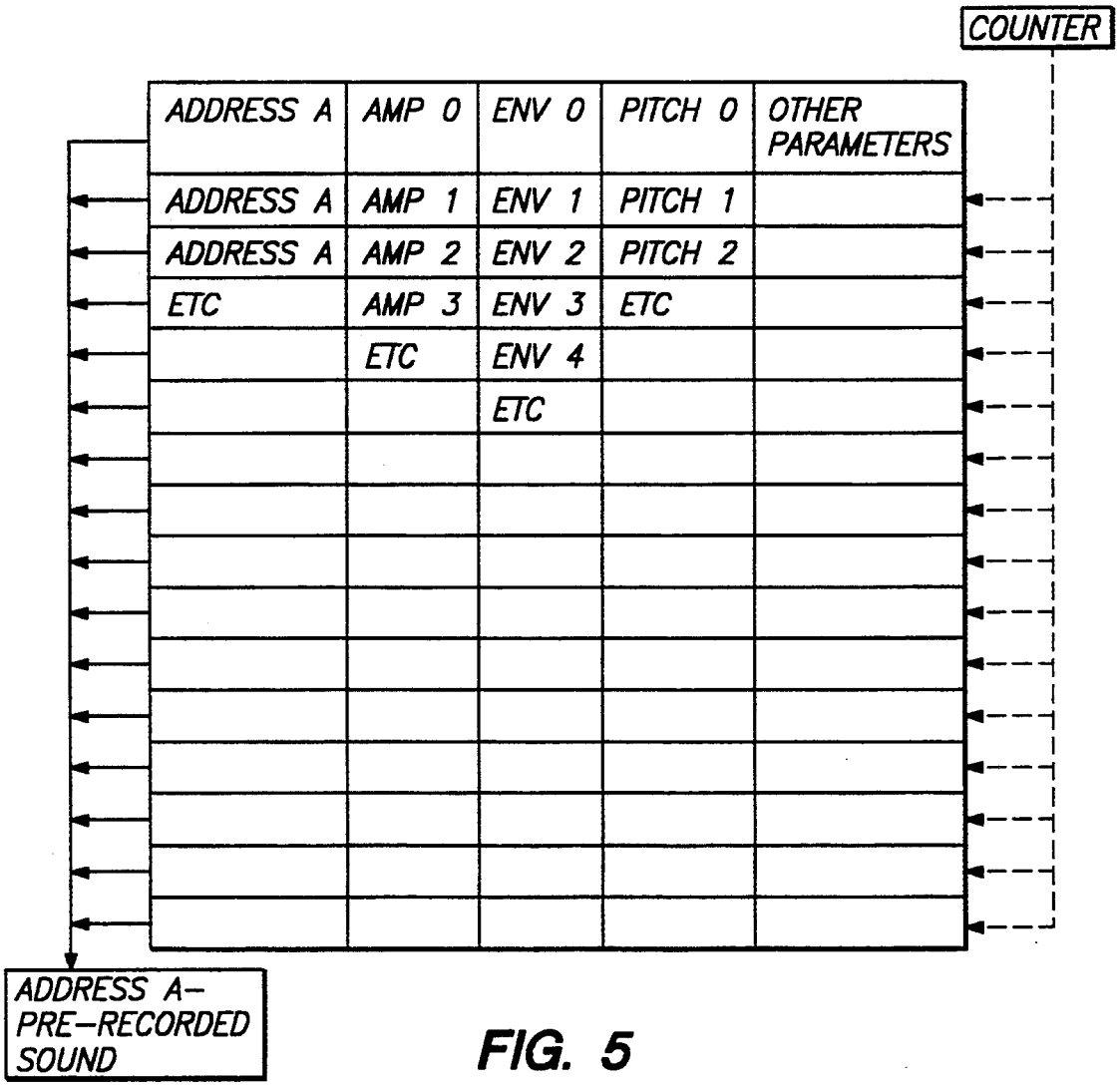
FIG. 5 illustrates one data structure which may be used to represent a sound pattern in the present invention.

In the preferred embodiment, the sequence of notes of a sound pattern is represented by a "list," i.e. a series of data. Each item in the list contains the address of the recorded sound to be played, and parameter instructions which tell the sound chip how to play that sound. One possible form of such a list is shown in FIG. 5. In this illustration, the pre-recorded note of a tambourine is held in address A. The tambourine sound pattern is 16 notes long. Thus, the list contains 16 data entries. Each data entry contains the address of the recorded tambourine sound, and thus points to the pre-recorded note, as represented by the solid lines. Each data entry also contains various parameters for playback of the tambourine sound, including amplitude, envelope and pitch as mentioned above, although these may be different for each entry in the list.

This representation of a large number of sounds of, for example, a tambourine by a single recorded sound and parameters for playback of that sound makes it possible to store a large number of related sounds in a minimal amount of memory, since far less memory is required to store the playback parameters than to store additional sounds.

Also shown in FIG. 5 is the counter for the tambourine sound pattern. As described above, the counter is incremented on each note, whether the tambourine pattern is selected or not, so that the system can always immediately add the tambourine pattern to the basic track if it is selected. Thus, the counter at all times points to the item in the list for the tambourine pattern which corresponds to the current note of the basic track, as shown by the dashed lines in FIG. 5. If, for example, the user selects the tambourine pattern on the seventh note of a song, the counter will point to the seventh data entry of the tambourine pattern list, which in turn will provide the address of the tambourine sound and the parameters for its playback to the play buffer, and in turn to the sound chip. (Note that while there are 16 data entries in the tambourine pattern list, they are numbered from 0 to 15 for ease of programming, since it is often easier to reset a counter to zero than to 1.)

Similarly to the tambourine example, a bass sound pattern may be represented by a single pre-recorded note and a list containing the desired number of notes, each entry containing the address of the note and the appropriate playback parameters. On the other hand, a drum sound pattern may contain 5 or 6 different pre-recorded sounds, each being for a different type of drum. But these sounds may still be repeated by having more than one entry in the list contain the address of each sound, and thus a sound pattern can be generated with far less memory than would be required to store a whole drum sequence.

Even the basic track of the song can be stored in this way, For example, if the song is a repeated measure, the basic track may be one pre-recorded measure and a list of data entries which are accessed sequentially and cause the pre-recorded measure to be accessed sequentially, just as the sound patterns.

Figure 6:
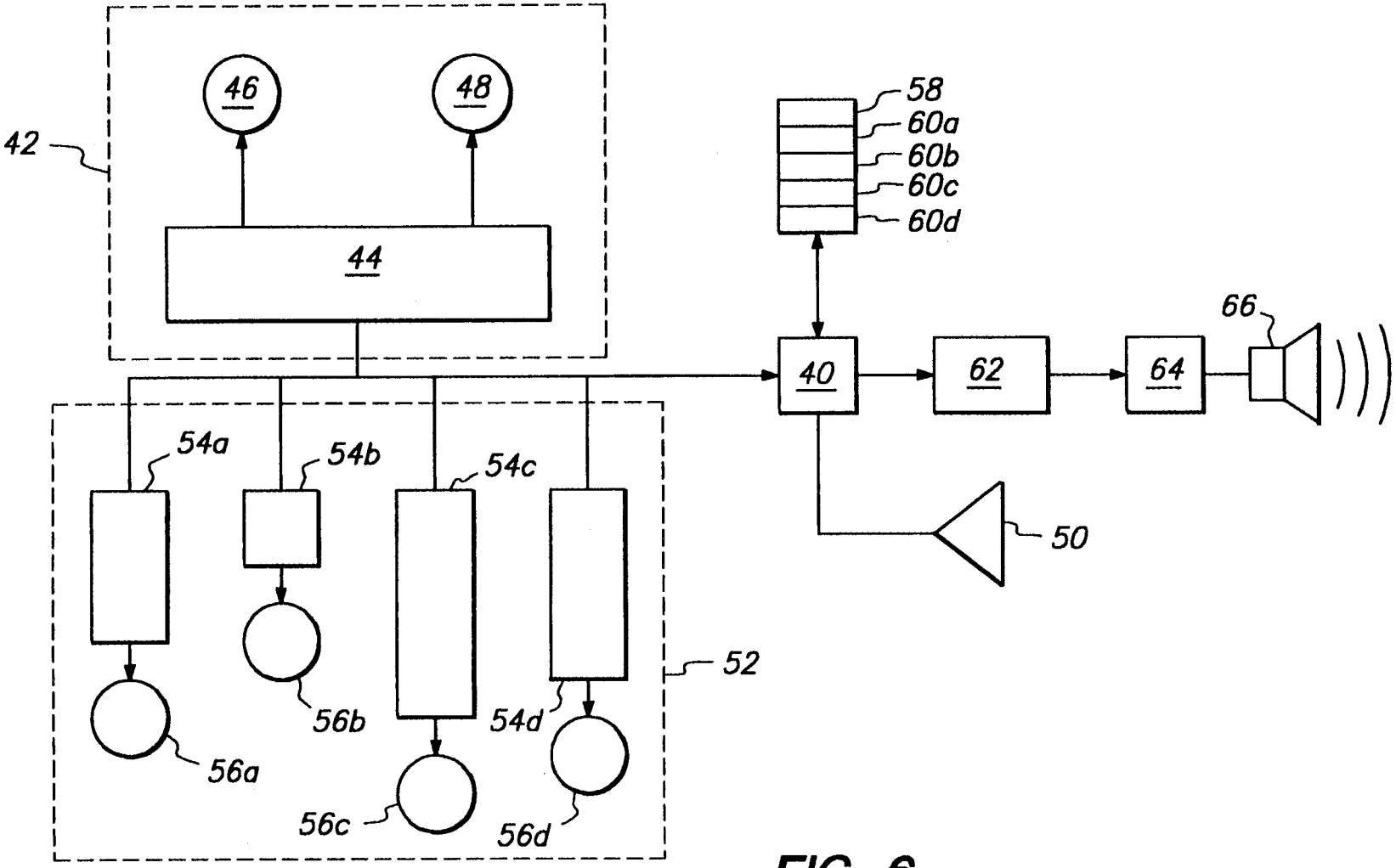
FIG. 6 is an illustration of one hardware embodiment of the present invention.

FIG. 6 shows one hardware embodiment of the present invention. A microprocessor 40 controls the system. The basic track information is contained in ROM 42, which has within it list data 44 and recorded sound data 46 and 48. The list data is retrieved by the microprocessor 40, and contains the addresses of the sound data 46 and 48 which make up two basic tracks in this case. When the system is turned on, these two basic tracks are played. Counter 58 counts the number of notes played.

The user has access to an input device 50 which allows selection of a sound pattern. The sound patterns are contained in ROM 52, which may be in the same ROM chip as ROM 42, being shown separate only for clarity. Four sound patterns are here shown represented by four lists 54*a–d*, each list pointing to corresponding sound data 56*a–d*. (Note, however, that a specific piece of sound data may be accessed by more than one list.) Counters 60*a–d* correspond to sound pattern lists 54*a–d*, and are incremented along with counter 58, each being reset when it exceeds the length of the corresponding list.

When the user selects a sound pattern on the input device 50, microprocessor 40 looks to the appropriate counter 60*a–d* to determine which entry in the selected sound pattern list 54*a–d* should be accessed, and obtains the data from the appropriate list and the corresponding sound data. This data is sent to buffer 62. When the end of a note cycle is reached, as calculated from an internal clock in microprocessor 40, the data in the buffer is sent to sound chip 64 which generates sounds from the data. The sounds are then played over an output device 66, which may be headphones or a stereo system.

In the above description, it is assumed that the sound chip can generate at least two notes in one note period, i.e. the basic track note and a sound pattern note. Most sound chips are capable of this. Many sound chips can generate more than two notes in one period; if one of these is used it is possible to have more than one "basic track." Thus, if it is desired that some notes of the basic track have added components, the other components can be recorded in different locations from the first basic track, and each addressed at the proper time, again just as the sound patterns.

Thus, obviously, it is also possible for more than one sound pattern to be added to the basic track(s) at one time. The only actual limitation on the number of basic tracks that can be accessed, or on the number of sound patterns which can be added, is the amount of memory available and the speed of the play buffer and sound chip. If too many sounds are included, the play buffer and the sound chip may be unable to generate the music in real time as desired.

Another way to implement this would be to have a step in the list contain the address of more than one note, and send all of the addresses to the play buffer and then to the sound chip. This is also within the concept of the present invention, again limited only by the capability of the sound chip and the ability of the programmer to include such a type of data storage.

The present preferred embodiment uses a sound chip known as OTTO from Ensoniq, believed to be capable of handling up to 32 sounds at once. Multiple basic tracks and/or sound patterns are thus well within the capability of the sound chip. While it is believed that the play buffer sends notes to this chip serially, and not in parallel, so that the notes actually start to play one after the other rather than all at once, the speed of the serial transfer is so fast that the user will be unable to tell that the notes are not really being played completely simultaneously. In addition, the notes will overlap, thus further enhancing the appearance of simultaneous play. One familiar with sound chips in general, or the OTTO chip specifically, will easily understand from the technical specifications of the chip how the chip is controlled, and thus how the parameter data described herein can be varied to vary the output of the chip.

In the preferred embodiment, to avoid confusing the user, while multiple basic tracks may be implemented in any given song, all of the basic tracks are inaccessible to the user and simply play when the system is activated. That is, the combination of basic tracks is the default condition of music that plays when the user does not select a pattern to impose on the basic track. Also, it is likely that a user would find multiple sound patterns to be confusing, and thus in the preferred embodiment only one sound pattern is added at any given time.

Finally, as noted above, the system looks for an interrupt at step 20, when it looks for a signal from the user through the input device. In the preferred embodiment, the user presses the same button that was pressed to start the music to stop the music, whereupon the system plays a final note based upon an address affiliated with the interrupt signal. This ending procedure may be altered as desired.

Many other variations may be made within the scope of the present invention. For example, the predetermined duration of the notes may vary from song to song depending upon the type of music to be played. This is done simply by altering the number of clock cycles of the microprocessor clock which equal the duration of a note. Generally the duration of each note in a song is the same, but this need not be the case, and it is possible to vary the duration of notes within a song, although this increases the complexity of the program required.

Another possible variation is to use a single counter and a processor rather than multiple counters, and to calculate the proper entry of a sound pattern list each time a pattern is selected by the user. Thus, the length of the selected pattern would be divided into the basic track counter which indicates the total number of notes played thus far, and the remainder would indicate the entry of the selected pattern list which should be called.

Yet another possible variation, given the capability of the sound chip to handle multiple notes, is to have each sound pattern "played" at all times, but have all patterns but the one or ones selected played at a zero amplitude, thus creating the same effect as if the ones selected are the only ones played.

One can also vary the input device. While the joystick of the described embodiment simply turns a selected sound pattern on and off, it is also possible to make the amplitude, or loudness, of the selected sound pattern a function of the distance that the joystick is pushed from the center position, thus also allowing the user to "fade" the sound patterns in or out of the song.

There are also many input devices other than a joystick which may be used within the present invention. For example, a pad of buttons, each selecting a sound pattern when pushed, could be used. An input device such as this could allow the user to select only one sound pattern, like the joystick, or could allow selection of up to all of the sound patterns, again given the capability of the sound chip. As another alternative, one could build a device of the present invention for use with a personal computer, and have the various functions controlled by a keyboard or mouse. It is even possible that in such a system the user could customize the basic tracks and/or the sound patterns. All of this is within the present invention.

In the preferred embodiment, it is contemplated that the actual system would consist of a self-contained main unit with the microprocessor and sound chip, as well as the counters and both RAM and ROM. The ROM would contain routines necessary for operation of the unit, but no music. The unit would have output jacks to allow the user to listen through headphones or by sending the output to a stereo system. There would be an input jack for a microphone, to allow the user to impose his or her own voice over the musical output of the sound chip. An internal battery would supply power with an additional jack for an AC power supply if desired.

The data needed for songs would be contained in cartridges containing additional ROM, much as video games are done. The ROM in the cartridge would contain the data, i.e. recorded sounds and data lists for one or more basic tracks and a set of sound patterns for a song. Other data in the cartridge would tell the microprocessor how many clock cycles make up the duration of one note for the song in the cartridge, so that each song may have a note length most suitable for the type of music, as well as the length of each sound pattern in the cartridge so that the sound pattern counters could be properly reset to zero when the length of each pattern was exceeded as above.

With current data compression techniques, it may also be possible to put the data for more than one song on a cartridge, or to allow more than one set of sound patterns which could be selected by the user. (This would require an additional function of the input device, such as another button, to allow the user to select which set of sound patterns is to be selected, with the joystick then selecting the specific pattern within that set.)

Ideally at least some of the data in the cartridge, i.e. the data lists needed to reproduce the recorded sound, would be downloaded into the RAM in the main unit when the cartridge is inserted. This would serve both to keep the cost of the cartridge as low as possible, since the cartridge would thus need nothing but ROM of even a slow access speed, and to allow the processing to be done in the main unit by the microprocessor so that speed of operation is maximized. Conversely, only minimal RAM would be needed in the main unit to contain the lists, which as above do not require much memory. The only access to the cartridge necessary after this downloading would be to obtain the sound data. This does not pose a problem, since even very slow ROM has access times of approximately 200 ns and even a relatively slow microprocessor runs at 10 Mhz, while the upper end of the audible frequency range is approximately 20 Khz. Thus, the delay in accessing the ROM in the cartridge will still be imperceptible to the user.

If enough memory is present, the song could even have vocals. In such a case, it would be possible to locate the vocal sounds in a different portion of memory (to be synchronized with the song just like the sound patterns) and then have a control such as a potentiometer for altering the level of the vocals or removing them completely so that the user could substitute his or her own voice if desired.

Another possibility is to allow the user to "record" his or her movements of the joystick, so that any combination of song and sound pattern created by the user can be stored in memory and then recreated as desired. Since all that is necessary is to keep track of the signals from the input device and the time at which they occur, the amount of memory required is very small. To record the user's voice, on the other hand, the amount of memory required would be quite large. While this is possible in theory, a more practical approach would be to record the song, with the user's voice, on a tape machine through the stereo output jacks.

From the above description, it will be apparent that the invention disclosed herein provides a novel and advantageous apparatus for playing a first sequence of sounds represented by data stored in memory synchronously with a second sequence of sounds represented by data stored in memory, at any point during the playing of the second sequence of sounds. The foregoing discussion discloses and describes merely exemplary methods and embodiments of the present invention. As will be understood by those familiar with the art, the invention may be embodied in other specific forms without departing from the spirit or essential characteristics thereof. A number of examples of possible variations have been suggested herein, and others will occur to those with skill or interest in the art. Accordingly, the disclosure of the present invention is intended to be illustrative, but not limiting, of the scope of the invention, which is set forth in the following claims.

What is claimed is:

1. An apparatus for playing, synchronously with a first sequence of sounds represented by data stored in memory, a second one of a plurality of sequences of sounds represented by data stored in memory at a selected point during the playing of the first sequence of sounds, comprising:

means for identifying the sound in each of the plurality of sequences of sounds which must be played at the same time as the sound in the first sequence of sounds which is to be played at the selected point for the sequences to be synchronous;

input means for selecting one of the plurality of sequences of sound to add to the first sequence;

a buffer for retrieving and holding the data representing both the identified sound in the selected sequence and the sound in the first sequence which is to be played at the selected point until a predetermined time; and sound generation means for generating the sounds represented by the data in the buffer at the predetermined time.

2. The apparatus of claim 1 wherein the means for identifying the sound in each of the plurality of sequences of sound further comprises a counter for counting the number of sounds in the first sequence which are played before the sound in the first sequence which is to be played at the selected point.

3. The apparatus of claim 2 further comprising a plurality of counters, one corresponding to each of the plurality of sequences of sound, which are incremented each time a sound in the first sequence is played, and reset to zero when the counter reaches a value equal to the number of sounds in the sound sequence to which the counter corresponds.

4. The apparatus of claim 1 further comprising memory means for storing the sounds in the first sequence and each of the plurality of sequences such that a first portion of memory holds digitized representations of sounds in the first sequence and the plurality of sequences and a second portion of memory holds parameters for playing back the digitized representations of sounds.

5. The apparatus of claim 1 further comprising memory means for storing the sounds in one of the plurality of sequences wherein a first portion of memory holds a digitized representation of a single sound for the sequence and a second portion of memory holds a list of parameters for the same sequence such that the digitized representation of the single sound may be played back a predetermined number of times with different parameters.

6. The apparatus of claim 1, wherein the input means is a positional device in which each position indicates which of the plurality of sequences of sound is to be added to the first sequence.

7. An apparatus for storing a plurality of predetermined sequences of sound having complementary beats and allowing them to be retrieved synchronously, comprising:

a memory for storing data representing the plurality of sequences of sound;

a buffer for retrieving and holding each sound in a first one of the plurality of sequences of sound until a predetermined time;

sound generation means for generating the sound represented by the data in the buffer;

a counter for counting how many sounds in the first sound sequence have been played;

a processor for calculating which sound in each of the plurality of sound sequences corresponds to the next note in the first sound sequence such that the beats of the sequences will be synchronous;

input means for selecting a second one of the plurality of sound sequences; and means for sending the data representing the sound in the selected second sound sequence that corresponds to the next note in the first sound sequence to the buffer at the same time as the next note in the first sound sequence such that the sounds are produced synchronously by the sound generation means.

8. The apparatus of claim 7 wherein a first portion of the memory holds digitized representations of sounds in the first sequence and the plurality of sequences of sounds and a second portion of the memory holds parameters for playing back the digitized representations of sounds.

9. The apparatus of claim 7 wherein a first portion of the memory holds a digitized representation of a single sound for one of the sequences and a second portion of memory holds a list of parameters for the same sequence such that the digitized representation of the single sound may be played back a predetermined number of times with different parameters.

10. The apparatus of claim 7 wherein the input means is a positional device in which each position indicates which of the plurality of sequences of sound is to be added to the first sequence.

11. A method of playing, synchronously with a first sequence of sounds represented by data stored in memory, a second one of a plurality of sequences of sounds represented by data stored in memory, at a selected point during the playing of the first sequence of sounds, comprising:

identifying the sound in each of the plurality of sequences of sounds which must be played at the same time as the sound in the first sequence of sounds which is to be played at the selected point for the sequences to be synchronous;

selecting one of the plurality of sequences of sounds as the second sequence of sounds;

retrieving and holding the data representing both the identified sound in the first sequence and the sound in the selected second sequence which is to be played at the selected point until a predetermined time; and generating the sounds represented by the identified data at the predetermined time.

12. The method of claim 11 wherein the step of identifying the sound in each of the plurality of sequences of sound further comprises counting the number of sounds in the first sequence which are played before the sound in the first sequence which is to be played at the selected point.

13. The method of claim 11 further comprising:

counting the number of sounds played in the first sequence;

comparing the number of sounds counted to the number of sounds in each one of the plurality of sequences of sound; and starting a new count for each one of the plurality of sequences of sound when the number of sounds in that sequence is exceeded.

14. The method of claim 11 further comprising storing the sounds in the first sequence and the plurality of sequences in a memory wherein a first portion of the memory holds digitized representations of sounds in the first sequence and the plurality of sequences of sounds and a second portion of memory holds parameters for playing back the digitized representations of sounds.

15. The method of claim 11 further comprising storing one of the plurality of sequence of sounds in memory wherein a first portion of the memory holds a digitized representation of a single sound and a second portion of the memory holds a list of parameters for the same sequence such that the digitized representation of the single sound may be played back a predetermined number of times with different parameters.

16. A method for storing a plurality of predetermined sequences of sound having complementary beats and allowing them to be retrieved synchronously, comprising:

storing data representing the plurality of sequences of sound in a memory;

generating each sound in a first one of the plurality of sequences of sound in order at predetermined intervals;

counting how many sounds in the first sound sequence have been played;

selecting a second one of the plurality of sequences of sounds;

calculating which sound in the selected second sequence corresponds to the next note in the first sound sequence such that the beats of the two sequences will be synchronous; and generating the sound in the selected second sound sequence that corresponds to the next note in the first sound sequence at the same time as the next note in the first sound sequence such that the sounds are produced synchronously.

17. The method of claim 16, wherein a first portion of the memory holds digitized representations of sounds in the plurality of sequences of sounds and a second portion of the memory holds parameters for playing back the digitized representations of sounds.

18. The method of claim 16 wherein a first portion of the memory holds a digitized representation of a single sound for one of the plurality of sequences of sound and a second portion of memory holds a list of parameters for the same sequence such that the digitized representation of the single sound may be played back a predetermined number of times with different parameters to create the sequence of sounds.

* * * * *